US007804405B2

(12) United States Patent
Norman et al.

(10) Patent No.: US 7,804,405 B2
(45) Date of Patent: Sep. 28, 2010

(54) TAMPER-EVIDENT BOTTLE OVERCAP FOR SUPPORTING AN ELECTRONIC TAG

(75) Inventors: Michael Norman, East Brunswick, NJ (US); Chester Kolton, Westfield, NJ (US); Robert Whittemore, Montgomery, NY (US)

(73) Assignee: B&G International, Inc., Newark, NJ (US)

( * ) Notice: Subject to any disclaimer, the term of this patent is extended or adjusted under 35 U.S.C. 154(b) by 328 days.

(21) Appl. No.: 11/517,014

(22) Filed: Sep. 7, 2006

(65) Prior Publication Data

US 2007/0062903 A1 Mar. 22, 2007

Related U.S. Application Data

(60) Provisional application No. 60/715,430, filed on Sep. 9, 2005.

(51) Int. Cl.
*G08B 13/14* (2006.01)

(52) U.S. Cl. ..... 340/572.1; 340/571; 340/572.8; 340/572.9; 340/691.1; 215/224; 215/201; 215/211; 215/277; 215/280; 220/257.1; 220/790

(58) Field of Classification Search ..... 340/571, 340/572.8, 572.9; 215/274–277, 280; 220/319, 220/257.1, 790
See application file for complete search history.

(56) References Cited

U.S. PATENT DOCUMENTS 3,685,676 A * 8/1972 Gach et al. ..... 215/220
3,756,444 A * 9/1973 McIntosh ..... 215/220
3,853,236 A * 12/1974 Ostrowsky ..... 215/220
3,915,326 A * 10/1975 Hrubesky ..... 215/219
4,089,463 A * 5/1978 Babiol ..... 215/329
4,405,161 A * 9/1983 Young et al. ..... 285/80
4,457,445 A * 7/1984 Hanks et al. ..... 220/214
4,471,982 A * 9/1984 Nielsen, Jr. ..... 292/307 B
4,674,778 A * 6/1987 Ruiz ..... 292/256.6
4,729,487 A * 3/1988 Wright ..... 215/220
4,813,564 A 3/1989 Cooper et al. ..... 215/366
5,602,530 A 2/1997 Holmgren ..... 340/572.1
5,625,347 A 4/1997 McLean et al. ..... 340/568.1
5,667,085 A * 9/1997 Ogden et al. ..... 215/220
6,137,413 A 10/2000 Ryan, Jr. ..... 340/572.8
6,254,139 B1 7/2001 Fresnel ..... 340/572.8
6,342,838 B1 1/2002 Kolton et al. ..... 340/572.1
6,360,908 B1 * 3/2002 Kline ..... 220/257.1
6,604,643 B1 8/2003 Michael et al. ..... 215/204
6,696,955 B2 2/2004 Kolton et al. ..... 340/572.8
7,048,179 B2 5/2006 Claessens et al. ..... 235/375
7,208,707 B2 * 4/2007 Clothier et al. ..... 219/618
7,394,383 B2 * 7/2008 Hager et al. ..... 340/572.8

* cited by examiner

*Primary Examiner*—Daniel Wu
*Assistant Examiner*—Son M Tang
(74) *Attorney, Agent, or Firm*—Hoffmann & Baron, LLP

(57) ABSTRACT

An overcap structure supports an electronic tag on a container cap. The overcap structure includes an overcap for supporting the electronic tag where the overcap is rotatably positionable about the cap of the container. The overcap includes a planar upper surface and depending annular skirt having an inwardly directed lip for positioning beneath the cap. The overcap is formed of mating components which are attachable about the cap preventing nondestructible detachment of the overcap from the container cap.

3 Claims, 6 Drawing Sheets

TAMPER-EVIDENT BOTTLE OVERCAP FOR SUPPORTING AN ELECTRONIC TAG

CROSS-REFERENCE TO RELATED APPLICATION

This application claims priority to U.S. Provisional Patent Application Ser. No. 60/715,430, filed on Sep. 9, 2005, which is incorporated herein by reference.

FIELD OF THE INVENTION

The present invention relates to a cap for supporting an electronic tag or marker tag. More particularly, it relates to an overcap which may be placed on the cap of a container, where the overcap supports an electronic tag such as a radio frequency identification (RFID) tag or an electronic article surveillance (EAS) tag and which provides an indication of an attempt to tamper with the overcap.

BACKGROUND OF THE INVENTION

Electronic tags are used for a variety of purposes including a tracking of items which contain the tag, inventory control, security and also to provide information which may be electronically readable. These tags or markers may include radio frequency identification (RFID) tags or electronic article surveillance (EAS) tags.

In a pharmaceutical industry, prescription medication containers can be supplied with such tags to track the prescription medications through its supply and delivery chain, supply information to the persons handling the prescription medication along the chain and also provide a theft deterrent to prescription containers having the RFID tag placed thereon.

Such tags are only beneficial if they remain with the container until such time as a container reaches its end user and thereby satisfies the purpose for which the tag is placed on the container. Until such time, it is desirable to assure that the tag remains with the container or at least provides an indication that the tag has been removed in an unauthorized manner.

It is, therefore, desirable to provide a structure which will secure an electronic tag to a container such as a prescription bottle and which will provide an indication of tampering if an authorized attempt is made to remove the tag from the bottle.

DETAILED DESCRIPTION OF THE PREFERRED EMBODIMENT

Figure 1:
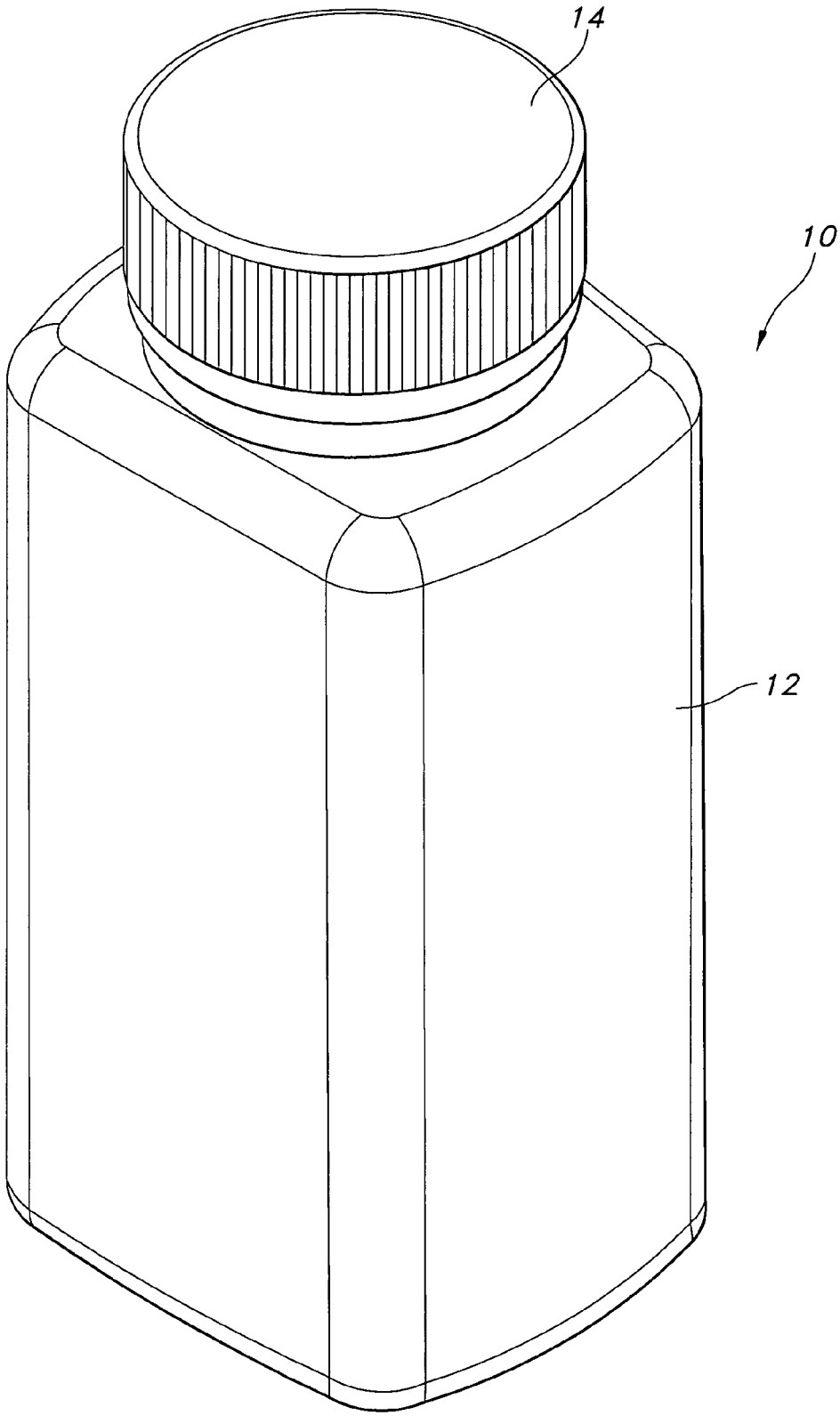
FIG. 1 is a perspective showing of the container which may be employed in combination with the present invention.

FIG. 1 shows a container 10, which may be used, for example, to contain pharmaceutical product. The container 10 includes a bottle 12 of conventional construction and a cap 14 which may be screw threaded onto a neck of the bottle to close the bottle. As may be appreciated, the present invention is not limited for use with the particular bottle shape shown.

Figure 2:
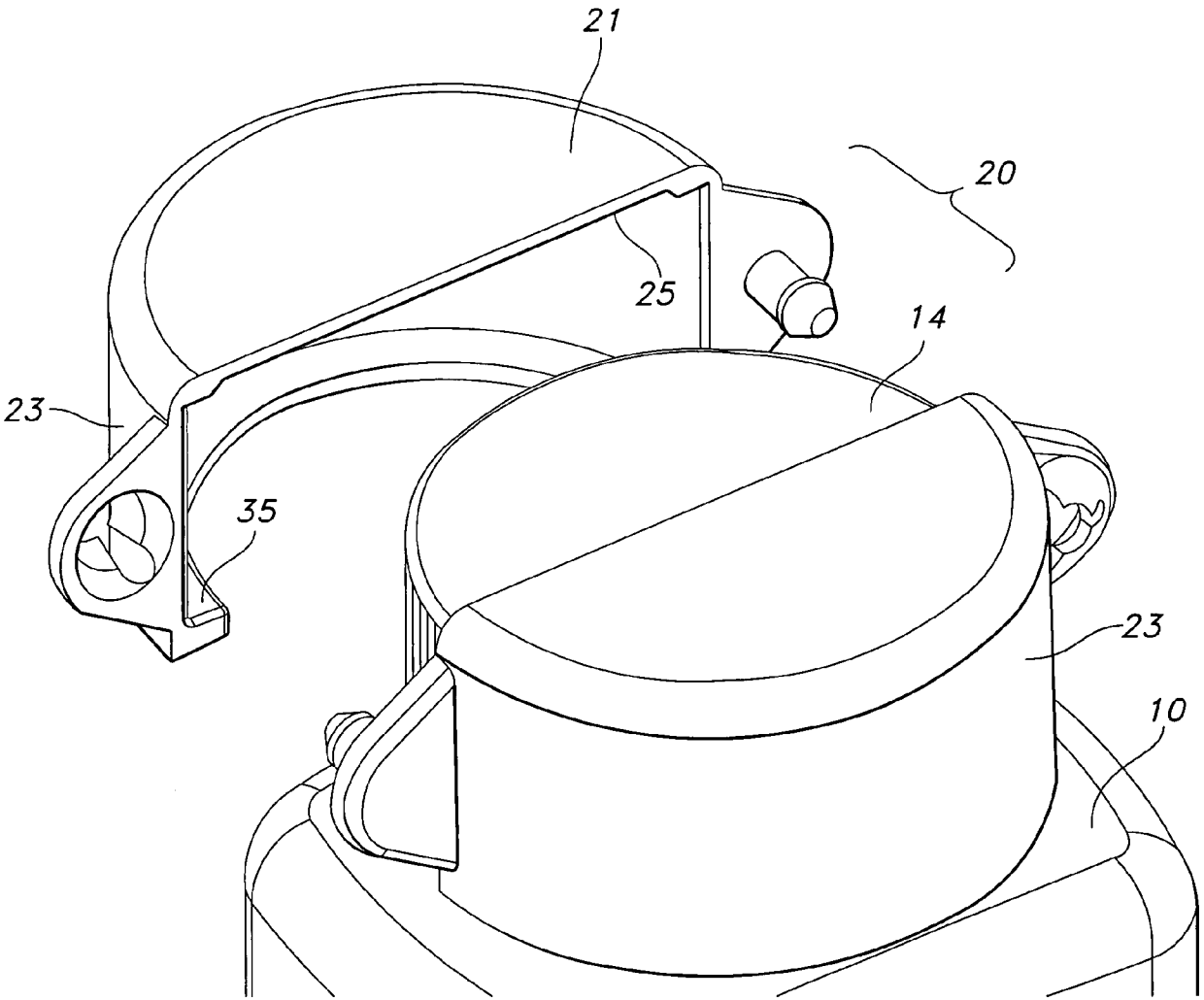
FIG. 2 shows the upper portion of the container of FIG. 1 with the overcap of the present invention.
Figure 5:
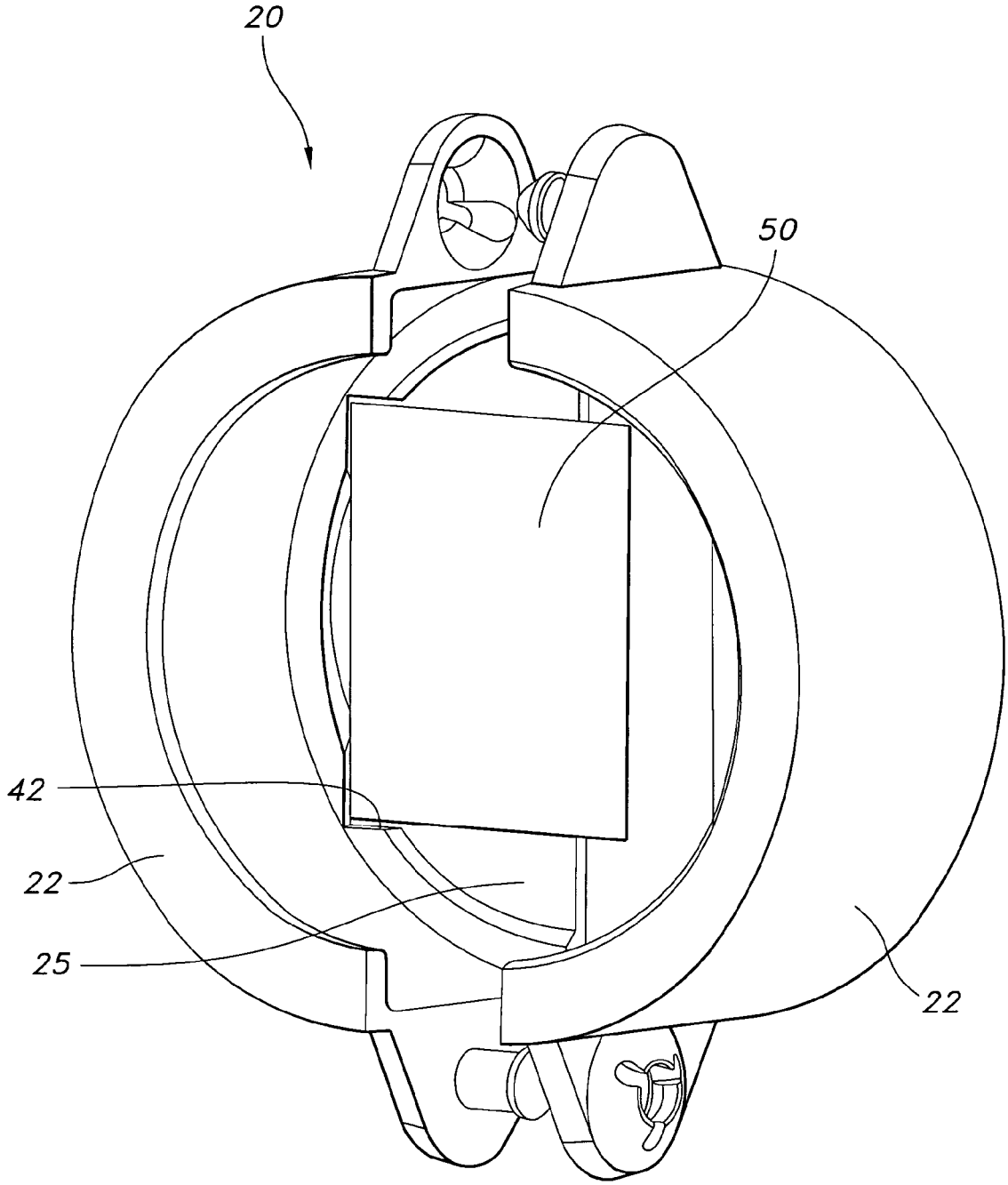
FIG. 5 is a perspective showing of an electronic tag positioned within the overcap of the present invention.

As shown in FIG. 2, the present invention provides an overcap 20 for placement over the cap 14 of container 10. The overcap 20 is generally cylindrical having a flat upper surface 21 and a depending annular skirt 23. As will be described in detail hereinbelow, the underside 25 of upper surface 21 is designed to support an electronic tag (FIG. 5). The distal end of skirt 23 includes an inwardly directed lip 35 which will also be described hereinbelow.

The overcap 20 is designed to be supported over cap 14 and be fixedly rotatable therearound while supporting the electronic tag thereto.

Figure 3:
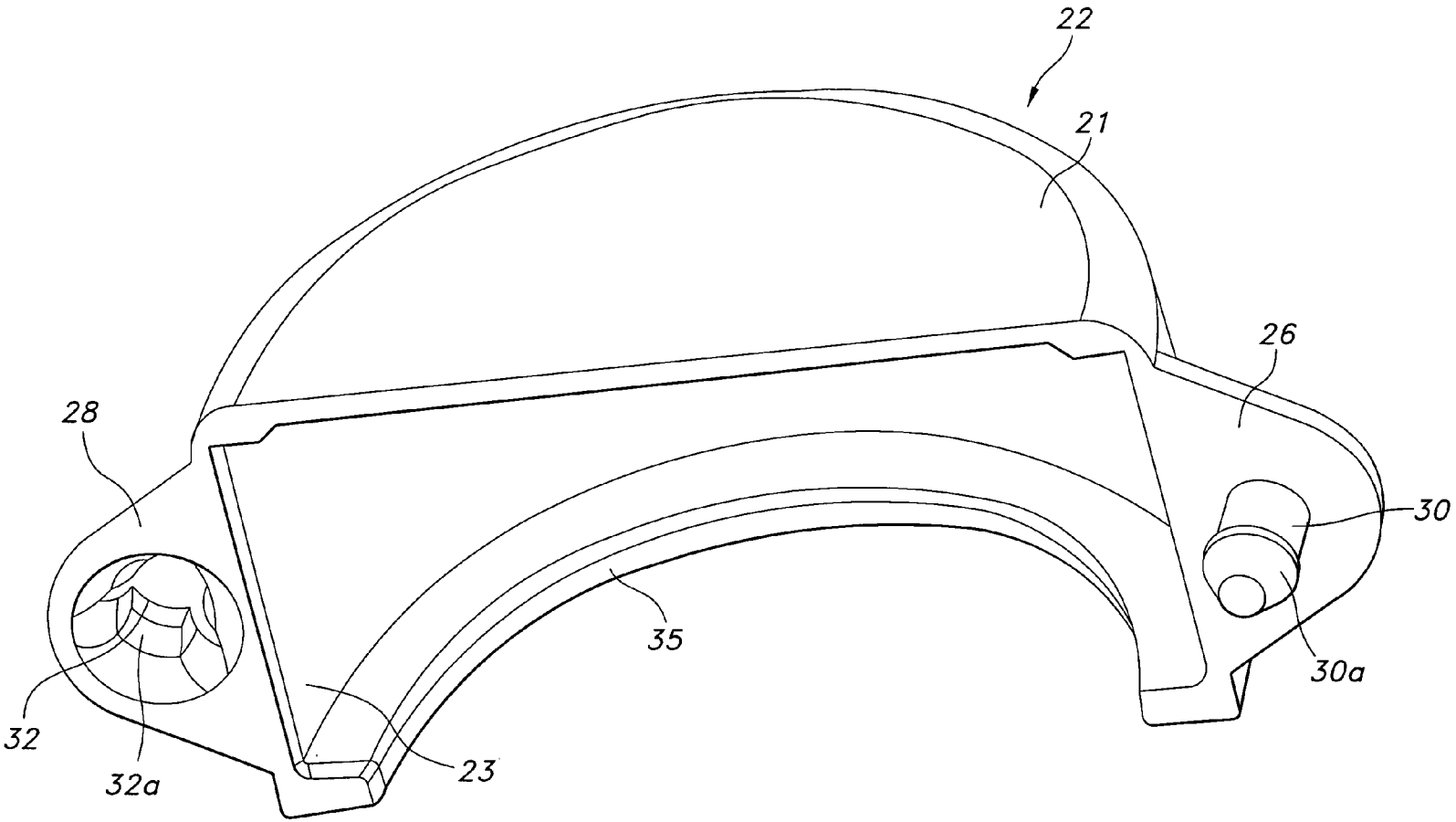
FIGS. 3 and 4 are perspective showings of one component of the two compartment overcap of FIG. 2.
Figure 4:
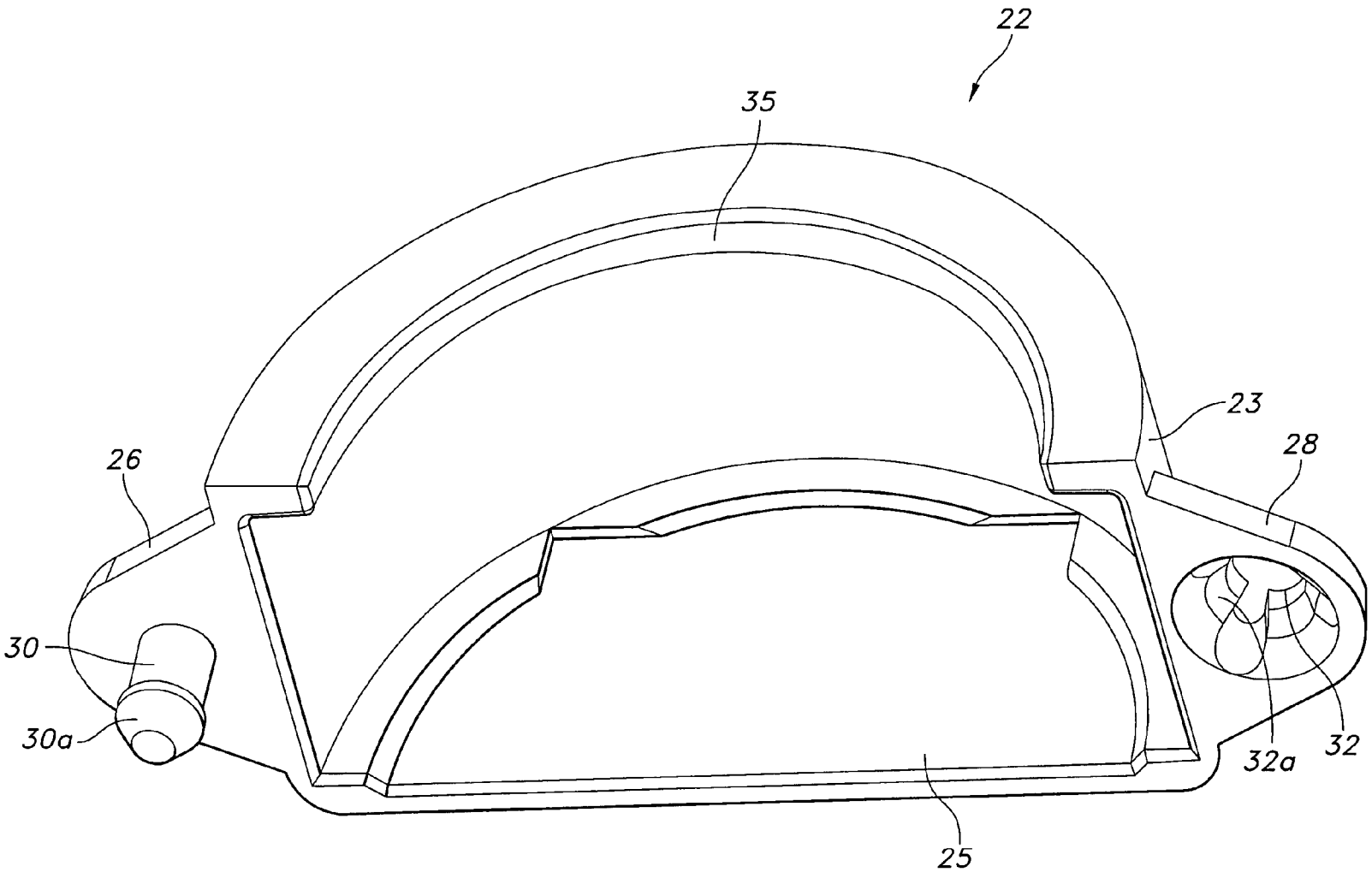

As shown and described in FIGS. 3 and 4, the overcap 20 shown is a two-part component formed of identical hermaphroditic mating halves. The components 22 are fitted together about cap 14 to form the generally cylindrical structure thereabout.

Each component 22 has a generally semi-cylindrical skirt 23 and a pair of diametrically extending ears 26 and 28. One of the ears 26 has a post 30 extending therebetween and the other ear 28 has a receiving aperture 32. The post 30 of one component 22 is designed for interlocking one way, snap engagement with the aperture 32 the other component 22 to form the cylindrical overcap 20. Such interlocking engagement prevents nondestructible detachment of the components once the components have been attached. In the preferred example, post 30 includes a tapered distal element 30*a* and aperture 32 include deflectable finger-like elements 32*a*. This arrangement provides for such one-way interlocking engagement.

The assembled components 22 forming the overcap 20 also defines the annular inwardly extending lip 35 at the lower end thereof. The lip 35 is designed to fit under the cap 14 of container 10. The fit is such that the overcap 20 can be freely rotated about cap 14 but cannot be removed therefrom without destructively disassembling the overcap 20 by separating the components 22. Such rotative positioning of overcap 20 on top of cap 14 prevents the cap 14 from being unscrewed from bottle 12 without first removing the overcap 20 therefrom.

Figure 6:
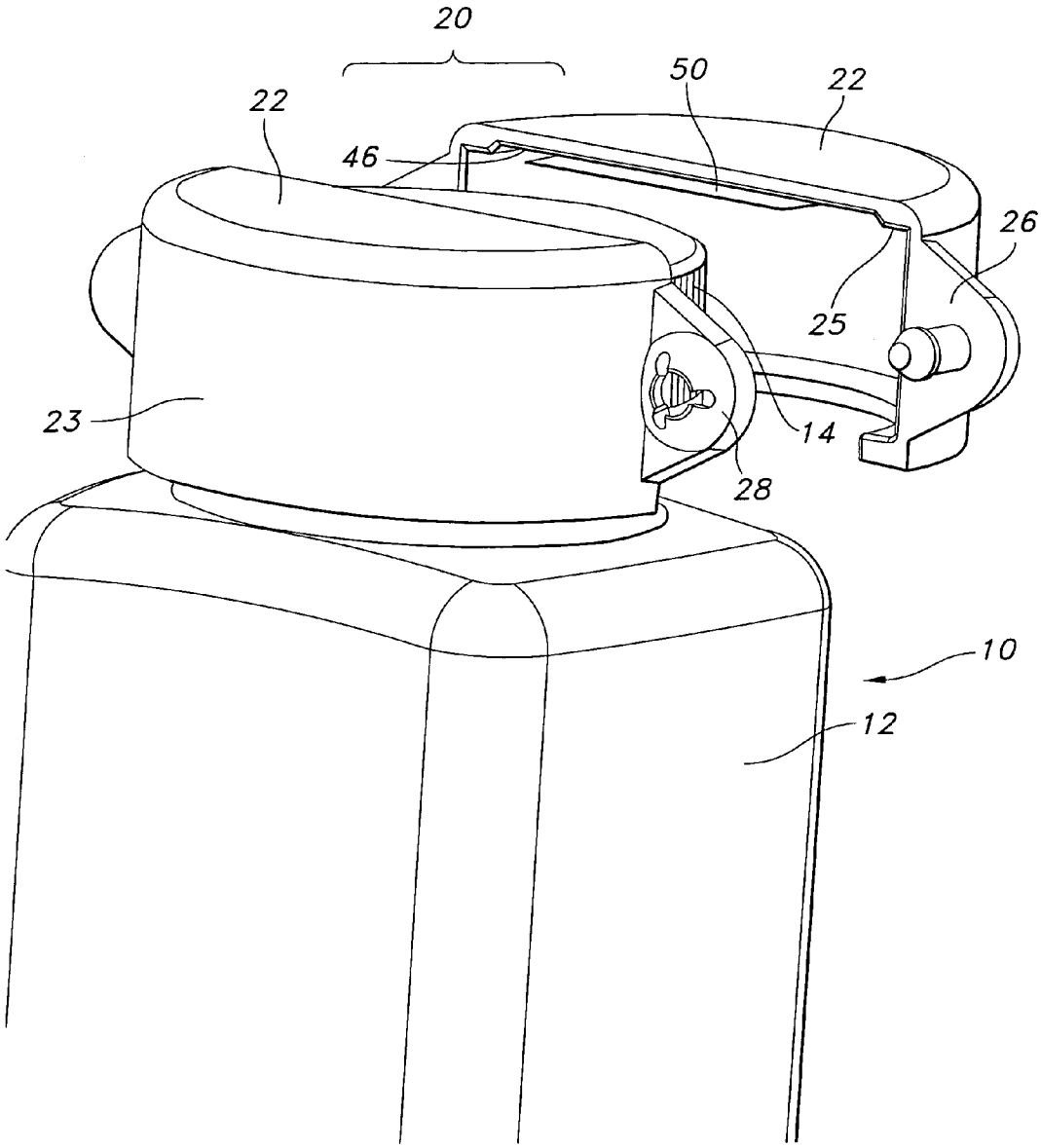
FIG. 6 shows the overcap with the electronic tag applied to the container in accordance with the present invention.

As shown in FIGS. 4-6, the underside 25 of the upper surfaces 21 of overcap 20 is notched providing a relief area 42 for accommodating an electronic tag 50. The tag 50 which is generally planar may be adhesively secured to the relief area 42 of overcap 20.

The tag 50 may be an EAS tag or an RFID tag or a tag which provides the combined features of both. While a generally square tag is shown, any tag configuration may be employed. It may be appreciated that the configuration of the relief area 42 will be constructed to conform to the tag configuration.

As shown in FIG. 6, the components 22 are assembled about cap 14 to form overcap 20. Prior to assembly about cap 14, tag 50 is placed on the relief area 46 of underside 25. The components 22 are "snapped" together at ears 26 and 28 to secure the overcap 20 in captive rotative engagement with cap 14.

Use of the tag 50 with the overcap 20 of the present invention may provide features such as article surveillance (theft prevention) and/or information regarding the product for purposes such as inventory and shipping control (RFID). Moreover, as the tag cannot be removed without destruction of the overcap 20, tamper indication is provided. This also assures that undetected access to the container is prevented, as the cap 14 cannot be removed without destructive removal of the overcap 20.

Various changes to the foregoing described and shown structures would now be evident to those skilled in the art.

Accordingly, the particularly disclosed scope of the invention is set forth in the following claims.

What is claimed is:

1. An overcap for placement on a cap rotatably positioned on a bottle comprising:

a pair of mating components;

interlocking means for securing said components together about said cap said interlocking means coupling said components for rotation about said cap without causing removable rotation of said cap and preventing non-destructible detachment of said components;

said components defining a lip for positioning beneath said cap for preventing removal of said overcap therefrom without detachment of said components; and an electronic tag supported within said overcap; wherein said mating component are hermaphroditic, each of said hermaphroditic includes a generally semi-cylindrical body having a pair of outwardly extending ears; wherein said interlocking means includes one of said ears having an extending post and the other of said ears includes a receiving aperture, the post of one of said mating components being snap engageable with the receiving aperture of said other mating component.

2. An overcap of claim 1 wherein said tag is selected from the group consisting of an EAS tag and a RFD tag.

3. An overcap of claim 1 wherein said mating components are identical.

* * * * *